United States Patent [19]

Yoshioka

[11] Patent Number: 4,908,010

[45] Date of Patent: Mar. 13, 1990

[54] APPARATUS FOR FOLDING AND CUTTING PAPER

[75] Inventor: Isamu Yoshioka, Fussa, Japan

[73] Assignee: Toppan Moore Co., Ltd., Japan

[21] Appl. No.: 114,613

[22] Filed: Oct. 29, 1987

[30] Foreign Application Priority Data

Oct. 31, 1986 [JP] Japan ..... 61-260147
Oct. 31, 1986 [JP] Japan ..... 61-260148
Oct. 31, 1986 [JP] Japan ..... 61-260149

[51] Int. Cl.[4] ..... B05B 1/14

[52] U.S. Cl. ..... 493/357; 225/103; 270/40

[58] Field of Search ..... 493/356, 357, 411, 412, 493/413, 414; 225/103; 270/40

[56] References Cited

U.S. PATENT DOCUMENTS 4,508,527 4/1985 Uno et al. ..... 493/357

*Primary Examiner*—Eugene R. LaRoche
*Assistant Examiner*—Robert J. Pascal
*Attorney, Agent, or Firm*—Ostrolenk, Faber, Gerb & Soffen

[57] ABSTRACT

An apparatus for folding and cutting a continuous length of paper. The apparatus includes (1) a folding mechanism for folding the paper into a stack of sheets, (2) a vertically movable supporting table for supporting the sheets, and (3) a cutting mechanism for cutting the paper.

4 Claims, 4 Drawing Sheets

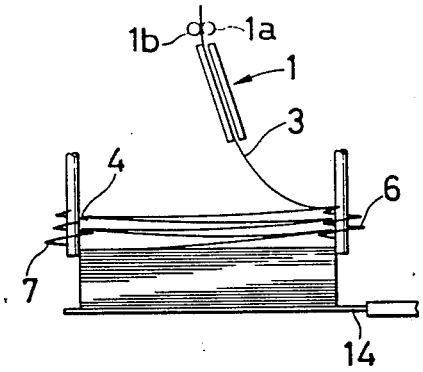
FIG.6
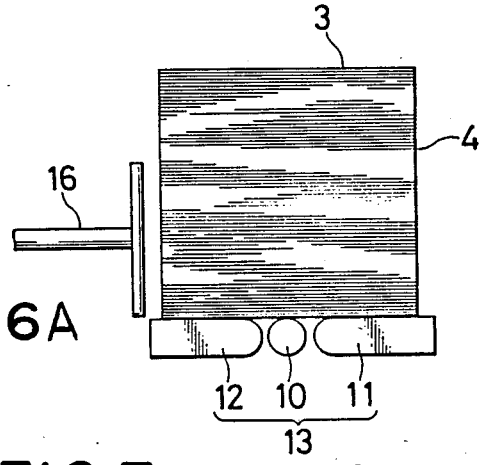
FIG.6A
FIG.7
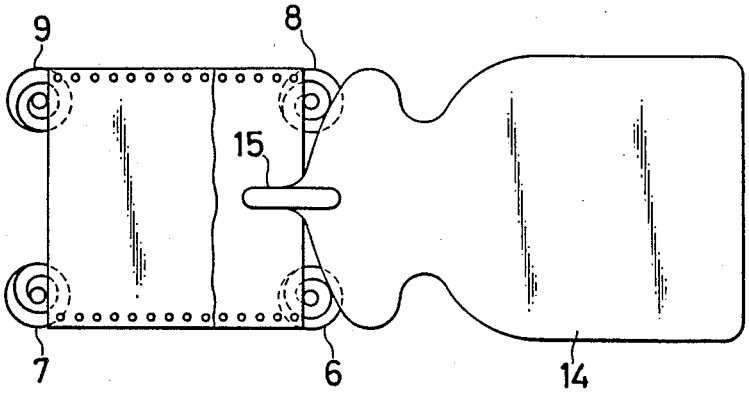
FIG.8
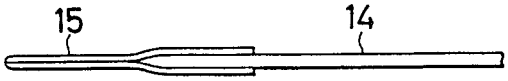

APPARATUS FOR FOLDING AND CUTTING PAPER

BACKGROUND OF THE INVENTION (1) Field of the Invention

The present invention relates to an apparatus for folding paper used for printing presses and office machines and then cutting the paper, and more particularly to an apparatus for folding and cutting paper formed with longitudinally directed folds at regular intervals. The paper is folded at the folds in a zigzagged form and cut when a desired amount is folded. The present invention also relates to a mechanism for supporting paper being fed from the top.

(2) Description of the Prior Art

An apparatus for folding and cutting a continuous length of paper in a zigzag form at folds thereof is disclosed in U.S. Pat. No. 4,508,527.

In the prior art apparatus, the paper is swung to be folded in the zigzag form. The paper is then alternately fed to a folding station and the folded sheets of paper are longitudinally stacked on a conveyor.

In the apparatus, the paper is cut at a fold by a cutting edge which is located below the folding station. The cutting edge is wider than that of the folding station. However, when the paper descends from the folding station, the descending state varies with the thickness of the paper, and it has been difficult to properly time the insertion of the cutting edge.

Further, when the sheets are longitudinally stacked on the conveyor below the folding station, the folds normally rise to eliminate any space for inserting the cutting edge such that the cutting edge cannot be stably inserted into the folded portion of the paper. Therefore, the paper becomes caught at a portion other than the portion desired to be cut. This leads to troubles such as tearing off, jamming, and the like. Positive insertion and cutting are important so as to accurately cut the paper after a predetermined number of sheets are folded.

Also, various mechanisms and conveyors are known for supporting sheets of continuous paper folded in a zigzag form. However, when the sheets are merely supported on a plane, as in the apparatus disclosed in U.S. Pat. No. 4,508,527, the upper portion of the supported sheets becomes concaved as the number of supported sheets increases. The support surface is therefore conventionally formed into a convex form to maintain the upper portion substantially as a plane.

For example, there is generally disclosed a supporting mechanism comprising a bearer and a pair of rotatable bearers located at opposite ends of the first mentioned bearer. The rotatable bearers are designed so that, when the weight of the supported sheets increases, the side ends of the rotatable bearers descend to support the sheets of paper so that the uppermost surface of the sheets is planar, whereas when the sheets are removed from the bearers, the rotatable bearers are again horizontal to facilitate the removing operation.

Manual cutting is cumbersome and the working efficiency is poor. When the paper is cut before the sheets are folded, it is difficult to time the cutting operation to obtain the desired amount of folded sheets. Cumbersome control has to be used to positively effect the folding operation when the paper is folded after being cut.

It is an object of the present invention to provide an apparatus for folding and cutting continuous paper while overcoming the aforementioned disadvantages.

As the folded sheets are fed from above, the folds remain inflated. It is difficult to overcome the inflated state by just the weight of the stacked sheets. But the steps of cutting the sheets removing the sheets from the supporting mechanism, and packing the sheets cannot be carried out smoothly unless the inflated state is eliminated.

In the prior art, the sheets are merely successively stacked and the inflated state of the folds is not eliminated.

It is a further object of the present invention to provide a mechanism for supporting folded sheets of continuous paper while overcoming the disadvantages noted above.

The aforementioned disadvantages resulting from automation may be overcome by cutting sheets of continuous paper during or after folding. However, as the folding operation progresses, the spacing between the sheets becomes narrow, making it difficult to insert a cutting edge between such sheets after a lapse of time.

SUMMARY OF THE INVENTION

The invention is directed toward an apparatus for folding and cutting a continuous length of paper, the paper having a longitudinal direction and fold lines spaced apart along the longitudinal direction, the fold lines dividing the paper into a series of adjacent sheets, the apparatus including: a folding mechanism for moving the paper in a zigzag fashion to fold the paper across the fold lines and to stack the sheets on top of each other; a vertically movable supporting table for supporting the sheets stacked by the folding mechanism, the supporting table descending according to the quantity of sheets supported thereon; and a cutting mechanism for cutting the paper when a desired quantity of sheets is supported on the supporting table, the cutting mechanism having a cutting edge with a tip which is pierced into an upper surface of one of the sheets while the sheet is being folded onto the stack and before an adjacent sheet is moved by the folding mechanism to be folded onto the stack, the cutting edge descending with the supporting table as the paper is folded, the cutting edge moving horizontally to cut the paper at one of the fold lines when the supporting table reaches a predetermined position.

Preferably, the apparatus further includes a first pair of spiral members at one side of the stack of sheets and a second pair of spiral members at an opposite side of the stack of sheets, the pairs of spiral members having uppermost portions, the pairs of spiral members (1) alternately supporting the sheets at the uppermost portions and (2) rotating to fold the sheets onto the stack and to feed the sheets downwardly.

Preferably, the apparatus further includes a driving mechanism for moving the cutting edge (1) downwardly at substantially the same speed as the speed at which the spiral members feed the sheets downwardly, (2) downwardly with the supporting table, and (3) horizontally to cut the paper.

Preferably, the apparatus further includes a central supporting member for supporting a substantial portion of the stack of sheets; and fold end supporting members for supporting portions of the stack near the fold lines, the fold end supporting members being capable of applying vertical pressing and moving forces to the portions of the stack near the fold lines.

Other features and objects of the invention will become apparent from the following detailed discussion of the preferred embodiments of the invention considered in conjunction with the accompanying drawings.

BRIEF DESCRIPTION OF THE DRAWINGS

FIGS. 2 to 6 and 6A explain the folding and cutting operations performed by the preferred embodiment;

FIG. 7 is a plan view showing the initial inserting state of a cutting edge; and FIG. 8 is a large side view of the tip of the cutting edge.

DETAILED DESCRIPTION OF THE INVENTION

The apparatus for folding and cutting continuous length of paper is designed to insert a cutting edge toward the paper immediately after folding.

With the invention, the step of inserting the cutting edge may be carried out easily and smoothly. There is nothing to impair the folding of the paper, and the cutting edge may be moved downward along with the supporting table while holding a suitable quantity of the folded sheets on the cutting edge. The cutting edge is moved horizontally while a certain weight is applied to paper in contact with both upper and lower surfaces of the cutting edge. Therefore, the paper can be cut in a stabilized state without being deviated.

Furthermore, the approximately central portion of the folded sheets is supported by the central supporting member whereas the areas near the turn portion of the paper is supported by the fold end supporting members and the areas near the folds of the paper are pressed and moved up and down so that they are pressed against each other thereby compressing the folds to overcome the inflation. In addition, the contact area between the paper and the fold end supporting members is extremely small, even when the fold end supporting members are displaced, since the central supporting member supports the paper in the shape of the letter "n". Therefore, cutting is carried out more smoothly, and the paper is not damaged due to friction from the pressing and movement of the fold end supporting members.

Figure 1:
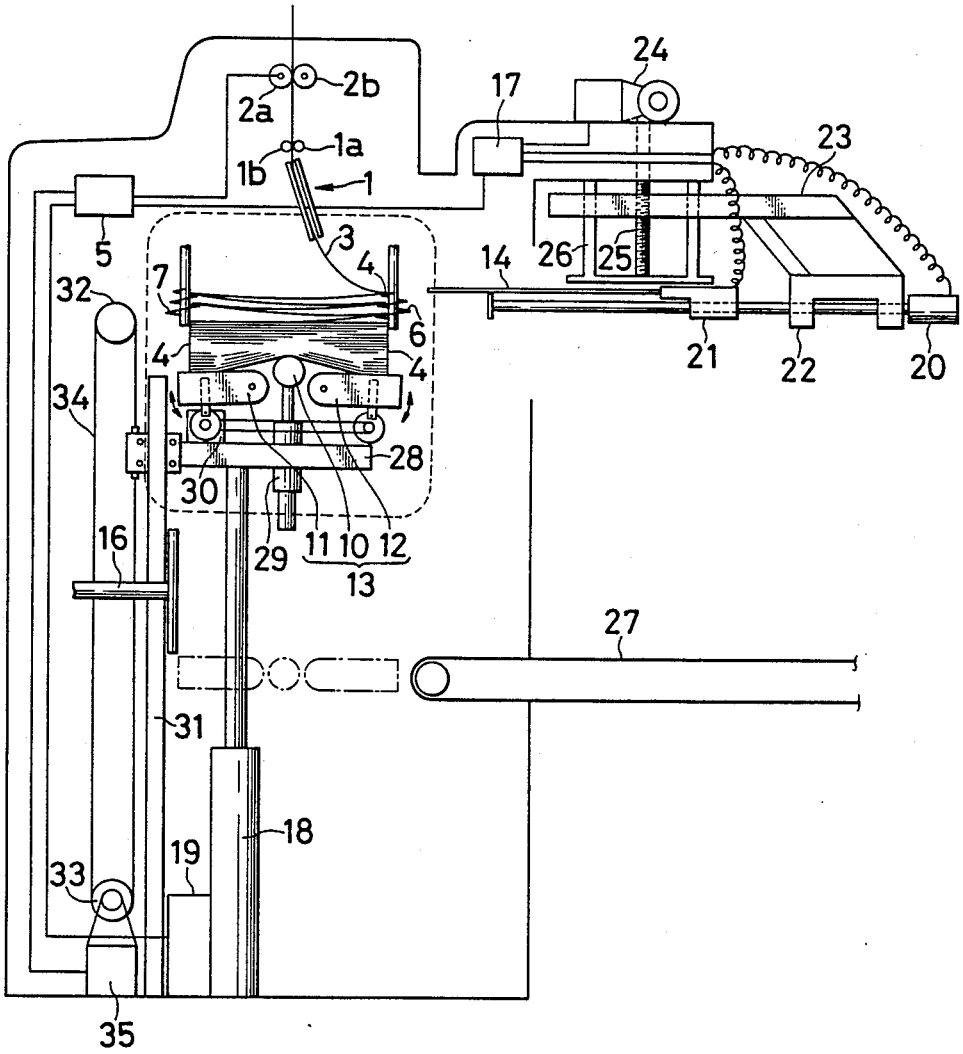
FIG. 1 is a schematic side view of a preferred embodiment in accordance with the invention.

Referring to FIG. 1, a folding member 1 is connected to a suitable drive mechanism (not shown) so as to be moved like a pendulum. A pair of guide rollers 1*a* and 1*b* are located above the folding member 1. Continuous paper 3 is supplied by a pair of feed rollers 2*a* and 2*b* to the guide rollers 1 and 1*b*. The paper 3 has folds 4 such as seams of a sewing machine at regular intervals in a longitudinal direction. The paper 3 is fed downwardly from the lower end. The folding member 1 is controlled so as to reciprocate once for every two folded sheets. That is, the paper 3 is fed downward in a zigzag fashion so as to be turned at the folds 4.

A cutting command station 5 is connected to a rotational shaft of the guide roller 2*a*. The cutting command station 5 detects the number of sheets fed thereby as a function of the number of rotations of the shaft and generates a control signal and a cutting command signal when a predetermined number of sheets are fed. The signal from the station 5 is fed to a control station 17 for driving and controlling a cutting mechanism, which will be described later.

Spiral members 6, 7, 8, and 9 (FIG. 7) are located below the folding member 1. The spiral members 6, 7, 8, and 9 are connected to and are rotatably supported on a suitable drive mechanism (not shown). The spiral members 6, 7, 8, and 9 receive areas near the folds 4. The drive mechanism is connected to the cutting command station 5 and controlled by the control signal from the cutting command station 5. The areas near the folds 4 are placed on two of the spiral members 6, 8 (or 7, 9 according to the operation of the folding member 1) and successively fed downwardly by the rotation of the spiral members 6, 7, 8, and 9. This operation causes the folding state of the folds 4 to become positive.

The spiral members 6, 7, 8, and 9 and the folding member 1 constitute a folding mechanism.

Referring to FIG. 1, a supporting table 13 is located below the spiral members 6, 7, 8, and 9. The table 13 has a central shaft 10 which is vertically movably supported on a lift bed 28 through an air cylinder 29 which is driven and controlled by the control signal from the cutting command station 5. The table 13 also has a pair of supporting plates 11 and 12 which symmetrically rise and fall by means of a crank mechanism. The crank mechanism is driven by a motor 30 which is driven and controlled by the control signal from the cutting command station 5.

The central shaft 10 supports the central portion of the folded paper 3, and is in the down position (indicated by broken lines in FIG. 1) when the paper 3 is drawn on a conveyor 27, which will be described later. But the shaft 10 normally supports the folded sheets of paper 3 in the up position (indicated by solid lines). When the central shaft 10 supports the folded paper 3 in the up position, the lower portion of the stacked sheets are supported in the shape of the letter "n" with the supporting plates 11 and 12 supporting the areas near the folds 4. Therefore, the supporting plates 11 and 12 contact the sheets in the neighborhood of the folds 4 even as the plates 11 and 12 rise and fall.

The lift bed 28 is vertically movably supported on a pair of columns 31 (only one of which is shown), and a chain 34 extends over a pair of sprockets 32 and 33. The sprocket 33 is connected through an electro-magnetic clutch (not shown) to an output shaft of a pulse motor 35 which is driven and controlled by the cutting command station 5. Thus, when the driving force of the pulse motor 35 is transmitted through the electromagnetic clutch, the chain 34 moves clockwise (as viewed in FIG. 1) to lower the lift bed 28 along with the supporting table 13. The extent to which the lift bed 28 is lowered is controlled according to the quantity of paper 3 positively folded on the supporting table 13, in other words, according to the length of paper 3 fed past the feed rollers 2*a* and 2*b*. An air cylinder 18 is provided below the lift bed 28. A rod projects from the cylinder 18 according to the control signal from the cutting command station 5 upon connection of the driving and control station 19 to the cutting command station 5 to move the lift bed 28 and the supporting table 13 upwardly.

Next, the cutting edge and a cutting mechanism for moving the cutting edge in horizontal and vertical directions will be described.

As shown in FIG. 1, in the standby state, the cutting edge 14 is positioned between the supporting table 13 and the folding member 1. The edge 14 is mounted on a rodless cylinder 21 which is connected to an air cylinder 20 and which is reciprocatable from left to right as viewed in the figure. The cutting edge 14 is freely movable into and out of the sheets from the direction of the fold 4 illustrated at the side of the spiral members 6 and 8. A supporting member 22 (which is mounted with the air cylinder 20 thereon) is secured to a lift member 23, which is moved up and down along a guide member by a rotational driving force of a threaded rod 25 which is rotated by a motor 24. Accordingly, the cutting edge 14 is also moved up and down by the motor 24. The motor 24, the air cylinder 20, and the rodless cylinder 21 are each connected to the control station 17 and driven and controlled by the control signal from the control station 17. As will be apparent from FIG. 7, the cutting edge 14 has a planar shape substantially in the form of a cutter. As can be best understood from FIG. 8, an elastic sheet-like guide edge 15 is secured to the tip surface of the cutting edge 14 by sandwiching the tip surface.

A reciprocable pressing and moving member 16 for ejecting the folded and cut paper 3 from the supporting table 13 onto the conveyer 27 is connected to a suitable driving mechanism (not shown). FIG. 6A corresponds to the lowermost down position of the supporting table 13 indicated by broken lines in FIG. 3.

In the following, the folding, supporting, and cutting operations of the preferred embodiment will be described with reference to FIGS. 1 to 7.

Figure 2:
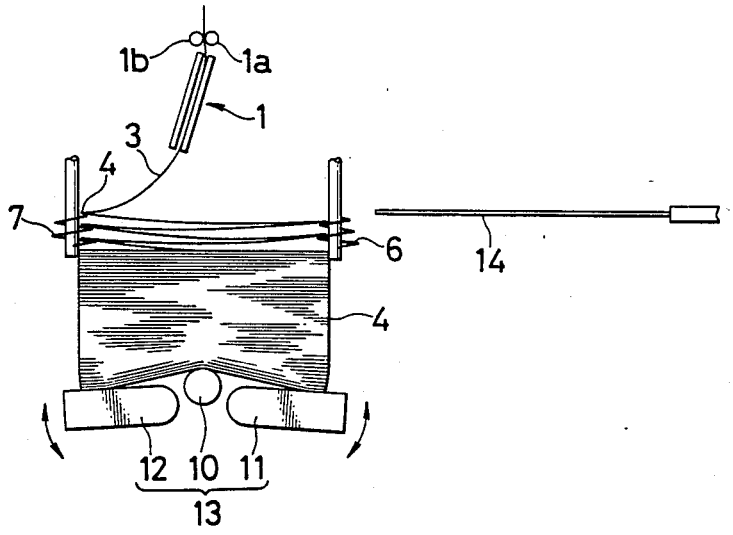

FIG. 1 shows the starting state of one folding and cutting cycle. The supporting table 13 is at its uppermost position, the central shaft 10 is at its uppermost position, and the cutting edge 14 is in the standby state (slightly above the upper surfaces of the spiral members 6 and 8). The paper 3 is folded in a zigzag form at the folds 4 by the pendulum-like operation of the folding member 1, positively folded by the spiral members 6, 7, 8, and 9, and descends toward the supporting table 13. Then, the supporting plates 11 and 12 of the supporting table 13 rise and fall by the motor 30, whereby the folded sheets are arranged and successively placed on the supporting table 13 such that the upper portion of the folded stack of sheets remains in a horizontal plane (FIG. 2). On the other hand, the supporting table 13 is moved down when the pulse motor 35 is driven by the control signal from the cutting command station 5 according to the quantity of paper 3 which has been fed.

Figure 3:
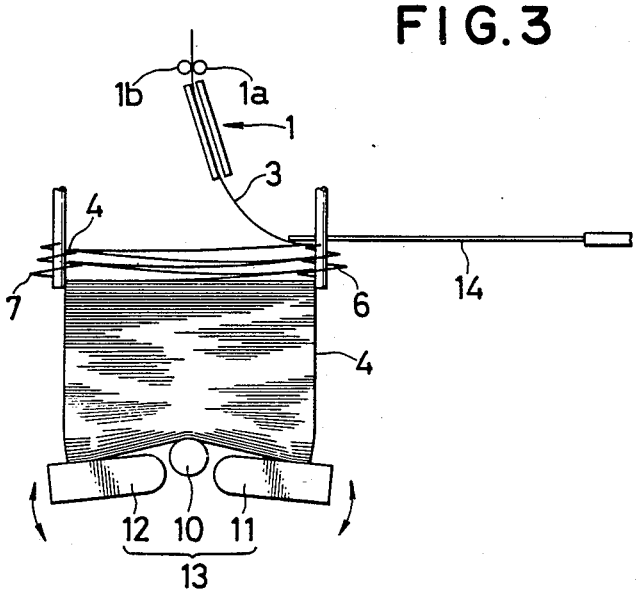
Figure 4:
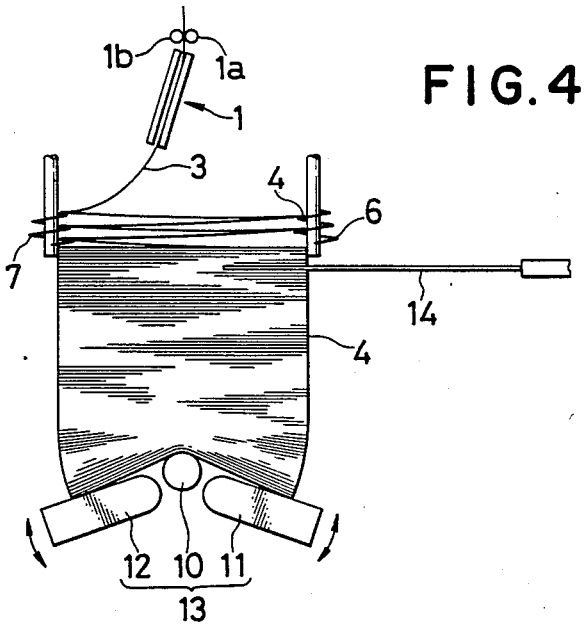

The cutting command station 5 detects that the desired amount of paper 3 is supported on the table 13 and the control signal is generated from the control station 17 to cause the air cylinder 20 to drive the cutting edge 14 so that the guide edge 15 rides on one of the sheets as illustrated in FIGS. 3 and 7. Subsequently, the cutting edge 14 is moved down as the motor 24 is driven by the control station 17. At that time, the cutting edge 14 is superposed within the spiral members 6 and 8 but is fed downwardly at the same speed as the speed of the paper 3 in the spiral members. The descent of the cutting edge 14 is controlled by the control signal from the cutting command station 5 such that the cutting edge 14 descends without contacting the spiral members 6 and 8 (FIG. 4). After the cutting edge 14 passes through the spiral members 6 and 8, it descends at the same speed as the supporting table 13.

Figure 5:
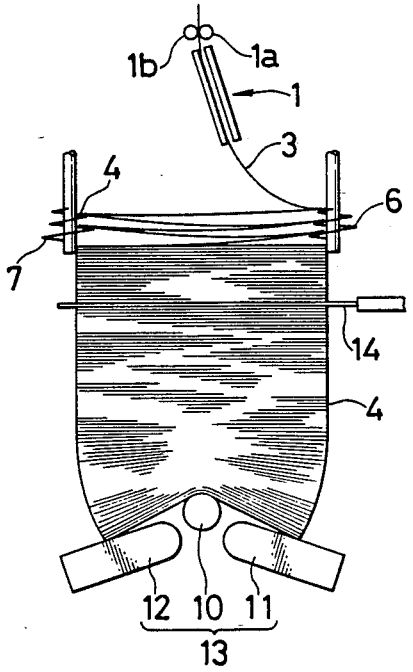

When the paper 3 is continuously folded and the supporting table 13 is moved down to the predetermined position, in other words, when the desired number of sheets have been folded and are supported above the cutting edge 14, the pulse motor 35 and the motor 30 are stopped by the control signal from the cutting command station 5. But the rodless cylinder 21 is driven by the control signal from the control station 17. Accordingly, the cutting edge 14 is driven to the left without moving downwardly. Meanwhile, the supporting table 13 is stopped and the supporting plates 11 and 12 are arranged as illustrated in FIG. 5. In this way, the guide edge 15 pierces through the fold 4 and the fold 4 is ruptured by the leading edge of the cutting edge 14. At this time, the folded sheets are supported on the cutting edge 14 and a suitable weight is applied thereto. As a result, the paper 3 is smoothly cut by the cutting edge 14. The motor 30 is stopped when the ends of the supporting plates 11 and 12 are in the ascended state (FIG. 5). The ascended state is detected by a sensor (not shown).

When the paper 3 is cut, succeeding folded sheets are supported by the cutting edge 14 (FIG. 6) whereas the supporting table 13 is again moved downwardly by the chain 34 and assumes the lowermost position. Then, the central shaft 10 is moved down to its lowermost position by the air cylinder 29, and the supporting plates 11 and 12 assume a horizontal posture at the same level as that of the supporting shaft 10. As a result, the desired quantity of folded sheets are transferred onto the conveyor 27 by the pressing and moving member 16.

Subsequently, after the electromagnetic clutch has been turned off to free the chain 34, the supporting table 13 is moved up to the uppermost position by the air cylinder 18, and the cutting edge 14 is moved to the right by the cylinders 20 and 21 whereby the folded sheets of continuous paper 3 which were supported by the cutting edge 14 are supported on the supporting table 13. The motor 24 is driven in reverse to return the cutting edge 14 to the standby position, and the central shaft 10 is also returned to the uppermost position (FIG. 1). After the electromagnetic clutch has been returned to the engaged state, the aforementioned operation is repeated whereby sheets are continuously folded and cut into desired quantities.

To cut the folded sheets of continuous paper 3 at the desired position, the cutting command station 5 for controlling the driving portions of the cutting edge 14, i.e., the cylinders 20, 21 and the motor 24, is operatively connected to a computer so that a command signal may be sent from the computer. Alternatively, a cutting indication mark may be marked on the paper 3 by a printing press or a printer of the computer and the aforementioned driving portions may be driven in response to the cutting indication mark. In any event, the desired quantity can be fixed or suitably variable.

The present invention is not limited to the aforementioned embodiments. For example, the folding mechanism is not limited to the folding member 1 and the spiral members 6, 7, 8, and 9. The folds 4 may be guided by impellers which rotate in the feeding direction of the paper, or by other guide members. When the paper 3 is developed with a bend, the guide members are not needed. In addition, the cutting edge 14 and the guide edge 15 may be constructed integrally, and the shape of the cutting edge 14 is not limited to a cuttle-shape. Furthermore, the supporting table 13 can be designed so that an inclination angle of the supporting plates 11 and 12 with respect to the central shaft 10 is a function of the quantity of paper 3, and is not limited to one composed of the vertically movable central shaft 10 and the supporting plates 11 and 12.

As will be apparent from the foregoing, with the present invention, paper can be automatically, efficiently, and accurately folded and then cut into desired quantities. In addition, the piercing of the cutting edge into the paper is smoothly achieved, and the folding operation is not impaired. These are useful advantages of the present invention.

Moreover, the folds are moved up and down by the supporting mechanism and compressed to thereby overcome the inflated state. As a result, cutting can be achieved more smoothly and drawing-out and packaging become easy. A further advantage is that since the contact area between the paper and the supporting mechanism is small, the paper is not damaged even if the fold-end supporting member is displaced.

The invention is not limited to the embodiments described and illustrated. Variations are possible within the scope of the claims.

What is claimed is:

1. An apparatus for folding and cutting a continuous length of paper, the paper having a longitudinal direction and fold lines spaced along the longitudinal direction, the fold lines dividing the paper into a series of adjacent sheets, said apparatus comprising:

a folding mechanism for moving the paper in a zigzag fashion to fold the paper across the fold lines and to stack the sheets on top of each other;

a vertically movable supporting table for supporting the sheets stacked by said folding mechanism, said supporting table descending according to the quantity of sheets supported thereon; and a cutting mechanism for cutting the paper when a desired quantity of sheets is supported on said supporting table, said cutting mechanism having a cutting edge with a tip which is pierced into an upper surface of one of the sheets while the sheet is being folded onto the stack and before an adjacent sheet is moved by the folding mechanism to be folded onto the stack, said cutting edge descending with said supporting table as the paper is folded, the cutting edge moving horizontally to cut the paper at one of the fold lines when said supporting table reaches a predetermined position.

2. The apparatus of claim 1, further comprising a first pair of spiral members at one side of the stack of sheets and a second pair of spiral members at an opposite side of the stack of sheets, said pairs of spiral members having uppermost portions, said pairs of spiral members (1) alternately supporting the sheets at said uppermost portions and (2) rotating to fold the sheets onto the stack and to feed the sheets downwardly.

3. The apparatus of claim 2, further comprising a driving mechanism for moving said cutting edge (1) downwardly at substantially the same speed as the speed at which said spiral members feed said sheets downwardly, (2) downwardly with said supporting table, and (3) horizontally to cut the paper.

4. The apparatus of claim 1, wherein said supporting table comprises:

a central supporting member for supporting a substantial portion of the stack of sheets; and fold end supporting members for supporting portions of the stack near the fold lines, said fold end supporting members being capable of applying vertical pressing and moving forces to the portions of the stack near the fold lines.

* * * * *